US006461173B1

(12) United States Patent
Mizuno et al.

(10) Patent No.: US 6,461,173 B1
(45) Date of Patent: Oct. 8, 2002

(54) HOT-PLUG CONNECTOR SMALL IN SIZE AND EXCELLENT IN CONTACT-FLATNESS AND METHOD OF MANUFACTURING THE SAME

(75) Inventors: Tamotsu Mizuno, Oume; Keisuke Nakamura, Akishima, both of (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 09/618,601

(22) Filed: Jul. 17, 2000

(30) Foreign Application Priority Data

Jul. 19, 1999 (JP) ..... 11-205152

(51) Int. Cl.[7] ..... H01R 12/00
(52) U.S. Cl. ..... 439/79; 439/83; 439/876
(58) Field of Search ..... 439/79, 83, 55, 439/876, 571

(56) References Cited

U.S. PATENT DOCUMENTS 5,213,514 A * 5/1993 Arai ..... 439/79

FOREIGN PATENT DOCUMENTS

| | | | |
|---|---|---|---|
| JP | 4-92390 | 8/1992 | ..... H01R/23/00 |
| JP | 7-77152 | 8/1995 | ..... H01R/43/16 |
| JP | 7-77153 | 8/1995 | ..... H01R/43/16 |

* cited by examiner

*Primary Examiner*—P. Austin Bradley
*Assistant Examiner*—Alexander Gilman
(74) *Attorney, Agent, or Firm*—Michael, Best & Friedrich LLC; J. Warren Whitesel

(57) ABSTRACT

In a hot-plug connector comprising a plurality of contacts used for a plurality of the uses, each of the contacts being provided with a peg portion for being mounted on a main surface of an electrical circuit board, a contact portion for removable connection to a mating contact of a mating connector, and a squeezed portion for being pushed into and hold by an insulator, the peg portions are equal in length to one another in a depth direction. The squeezed portions are equal in length to one another in the depth direction. The contact portions are different in length in the depth direction from one another so as to correspond to the uses. Therefore, the peg and the squeezed portions are located at the same location in the depth direction. The contact portions are protruded to the different location from each other in the depth direction.

4 Claims, 9 Drawing Sheets

HOT-PLUG CONNECTOR SMALL IN SIZE AND EXCELLENT IN CONTACT-FLATNESS AND METHOD OF MANUFACTURING THE SAME

BACKGROUND OF THE INVENTION

This invention relates to a connector for electrical and removable connection between an electrical circuit board mounting the connector thereon and an electrical device having a mating connector removably connected to the connector and, in particular, to a hot-plug connector capable of carrying out the connection and the disconnection even while electric power is supplied to the electrical circuit board and/or the electrical device.

Conventionally, there was the matter with a conventional connector in that electric chips such as an IC (Integrated Circuit) mounted the electrical circuit board and/or the electrical device damage when the mating connector is plugged in/out to/from the connector while electric power is supplied to the electrical circuit board and/or the electrical device.

In order to settle the matter mentioned above, the hot-plug connector is provided and used. The hot-plug connector is provided with a plurality kind of contacts respectively corresponding to a plurality kind of the uses. Each of the contacts is provided with a contact portion for contacting to a mating contact of the mating connector. The contact portions are different in length with one another. With this structure, the contacts of the hot-plug connector connect/disconnect to/from the mating contacts of the mating connector with a time lag. The time lag serves to prevent the electrical chip from damaging.

Such kinds of the hot-plug connector is disclosed for example in Japanese Utility Unexamined Publication (JP-U) No. 92390/1992 and Japanese Patent Examined Publications (JP-B) Nos. 77152/1995 and 77153/1995. In these Publications, the hot-plug connector used for connecting/disconnecting to/from the mating connector attached to a PC (Personal Computer) card standardized in PCMCIA (Personal Computer Memory Card International Association) as the electrical device are described. The hot-plug connector can connect to the mating connector attached on the PC card so that the contacts connect to the mating contacts with the time lag. Namely, a VCC contact (for power supplying) and a GND contact (for grounding), signal contacts (for transmitting data signals and the like), and a CD contact (for detecting the PC card) of the hot-plug connector connect to the mating contacts in this "three steps" order.

The hot-plug connector is generally attached to the electrical circuit board so that peg portions of the contacts are mounted on a surface of the electrical circuit board by soldering. Such mounting process is called as an "SMT (Surface Mounting Technology)".

It is requested for the hot-plug connector to be mounted by the SMT that surfaces of peg portions to be contacted to the surface of the electrical circuit board as a mounting object of the contacts are as small in area as possible. The smaller in area of the peg portions the more preferable to efficiency use an area pre-limited of the surface of the electrical circuit board.

Furthermore, it is also requested for the hot-plug connector to be mounted by the SMT that contact-flatness is excellent so as to be not larger than 0.1 mm. Herein, the contact-flatness indicates degree how the surfaces of the peg portions are equal in protruding-height/sinking-depth to one another. The contact-flatness is shown by height difference value of the surface from the criterion height of the peg portions. The contact-flatness is also called as "bottom surface uniformity of contacts" in EIAJ (Electronic Industries Association of Japan).

The conventional hot-plug connector has disadvantage such as to be large in area for mounting thereof because of a structure in which the contacts is thrust into an insulator so as to be different in insertion depth into the insulator from one another.

Furthermore, the conventional hot-plug connector also has the other disadvantage such as to be inferior in the contact-flatness. This is because it is impossible of maintaining the peg portions of smaller value in the contact-flatness over long length in the depth direction.

SUMMARY OF THE INVENTION

It is therefore an object of this invention to provide a hot-plug connector small in size and excellent in the contact-flatness.

The other objects, features, and advantages of this invention will become clear as the following description proceeds.

This invention is directed to a hot-plug connector capable of carrying out electrical and removable connection between an electrical circuit board mounting the hot-plug connector thereon and an electrical device having a mating connector removably connected to the hot-plug connector even while electric power is supplied to the electrical circuit board and/or the electrical device, the hot-plug connector comprising a plurality of contacts used for a plurality of the uses and an insulator used for holding the contacts on the electrical circuit board so that the contacts are arranged in a width direction which is parallel to a main surface of the electrical circuit board, each of the contacts being provided with a peg portion, located on one end of the contact in a depth direction which is parallel to the main surface of the electrical circuit board and along which the mating connector is connected to/removed from the hot-plug connector, for being mounted on the main surface of the electrical circuit board, a contact portion, located on the other end of the contact in the depth direction, for the removable connection to a mating contact of the mating connector, and a squeezed portion, located between the peg and the contact portions in the depth direction, for being pushed into and hold by the insulator. The peg portions are equal in length to one another in the depth direction. The squeezed portions are equal in length to one another, in the depth direction. The contact portions are different in length in the depth direction from one another so as to correspond to the uses. The peg portions are located on the main surface of the electrical circuit board at the same location in the depth direction. The squeezed portions are located at the same location in the depth direction. The contact portions are protruded to the different location from each other in the depth direction.

This invention is also directed to a method of manufacturing a hot-plug connector, the hot-plug connector being capable of carrying out electrical and removable connection between an electrical circuit board mounting the hot-plug connector thereon and an electrical device having a mating connector removably connected to the hot-plug connector even while electric power is supplied to the electrical circuit board and/or the electrical device, the hot-plug connector comprising a plurality of contacts used for a plurality of the uses and an insulator used for holding the contacts on the electrical circuit board so that the contacts are arranged in a width direction which is parallel to a main surface of the electrical circuit board, each of the contacts being provided with a peg portion, located on one end of the contact in a depth direction which is parallel to the main surface of the electrical circuit board and along which the mating connector is connected to/removed from the hot-plug connector, for being mounted on the main surface of the electrical circuit, board, a contact portion, located on the other end of the contact in the depth direction, for the removable connection to a mating contact of the mating connector, and a squeezed portion, located between the peg and the contact portions in the depth direction, for being pushed into and hold by the insulator. The method comprises the steps of preparing the contacts so that the peg portions are equal in length to one another in the depth direction, that the squeezed portions are equal in length to one another in the depth direction, that the contact portions are different in length in the depth direction from one another so as to correspond to the uses, and that said contacts are connected to one another by a carrier-frame so that the peg portions are arranged in line, attaching the contacts to the insulator by pushing the contacts into the insulator so that the peg portions are located at the same location in the depth direction, that the squeezed portions are located at the same location in the depth direction, and that the contact portions are protruded to the different location from each other in the depth direction, and cutting the carrier-frame away form the contacts.

DESCRIPTION OF THE PREFERRED EMBODIMENTS

Figure 1A:
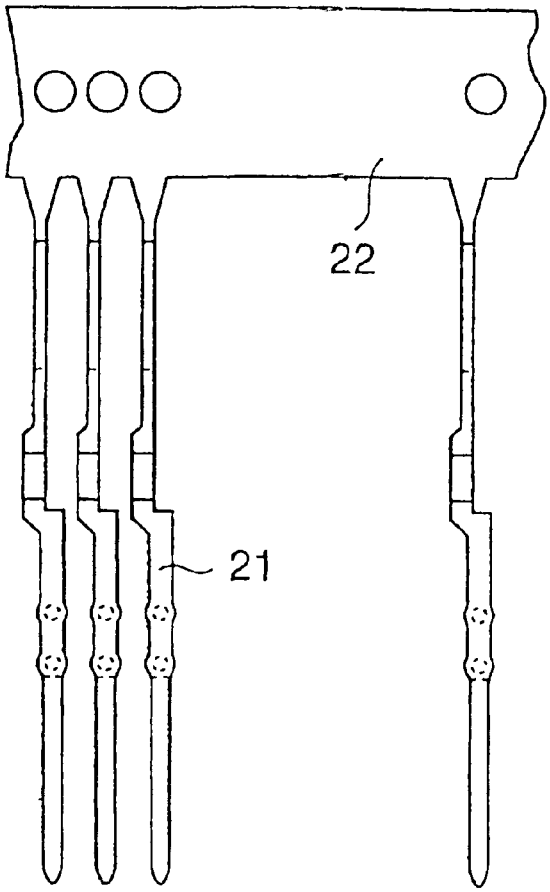
Fig.1A Prior Art
FIGS. 1A and 1B are a plan view and a side view showing contacts which will be used in a conventional hot-plug connector.

In order to facilitate an understanding of this invention, description will at first be made with reference to the drawing about a conventional hot-plug connector of a type described in the preamble of the present specification.

Referring to FIGS. 1A, 1B, 2, and 3, the conventional hot-plug connector can carry out electrical and removable connection between an electrical circuit board (not shown) mounting the hot-plug connector thereon and an electrical device (not shown) having a mating connector (not shown) removably connected to the hot-plug connector even while electric power is supplied to the electrical circuit board and/or the electrical device.

The hot-plug connector comprises a plurality of contacts 21 used for a plurality of the uses and an insulator 23 used for holding the contacts 21 on the electrical circuit board so that the contacts 21 are arranged in a width direction which is parallel to a main surface of the electrical circuit board.

The use of each of the contacts 21 is the VCC contact (for power supplying) and the GND contact (for grounding), the signal contacts (for transmitting data signals and the like), or the CD contact (for detecting the PC card) of the hot-plug connector connect to the mating contacts.

Each of the contacts 21 is provided with a peg portion 211, a contact portion 212, and a squeezed portion 213.

The peg portion 211 is located on one end of the contact 21 in a depth direction (left and right directions in FIGS. 2 and 3) parallel to the main surface of the electrical circuit board and along which the mating connector is connected to/removed from the hot-plug connector and used for being mounted by soldering on the main surface of the electrical circuit board.

The contact portion 212 is located on the other end of the contact 21 in the depth direction and used for the removable connection to a mating contact of the mating connector.

The squeezed portion 213 is located between the peg and the contact portions 211 and 212 in the depth direction and used for being pushed into and hold by the insulator 23.

The conventional hot-plug connector is manufactured as the follows.

The contacts 21 are prepared. Herein, the contacts 21 are connected to one another by a carrier-frame 22 so that the peg portions 211 are arranged in line (in left and right directions in FIGS. 1A and 1B) as shown in FIGS. 1A and 1B.

Figure 1B:
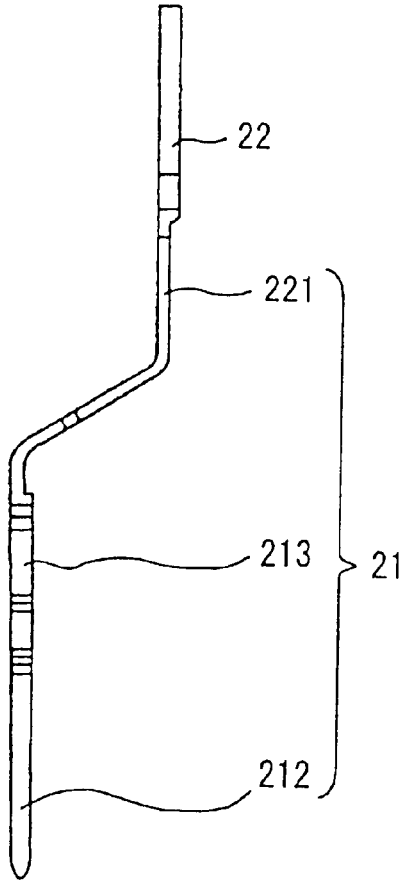
Fig.1B Prior Art

In the contacts 21, the peg portions 211 are equal in length to one another in the depth direction (upward and downward directions in FIGS. 1A and 1B). Also, the squeezed portions 213 are equal in length to one another in the depth direction. Furthermore, the contact portions 212 are equal in length to one another in the depth direction. Namely, the peg, the contact, and the squeezed portions 211, 212, and 213 are equal in length to one another in the depth direction and formed into the same shape as one another, respectively.

Next, the contacts 21 are attached to the insulator 23 by pushing the contacts 21 into (holes formed through) the insulator 23 at three times.

Firstly, all of the contacts 21 shown in FIGS. 1A and 1B are pushed or squeezed into the insulator 23 so that the contact portions 212 are located at a first location where the contact portions 212 of the contacts 21 as the DC contacts must be located in the depth direction. Then, the carrier-frame 22 is cut away from the contacts 21.

Secondly, any of the contacts 21 predetermined are further pushed into the insulator 23 so that the contact portions 212 are located at a second location where the contact portions 212 of the contacts 21 as the signal contacts must be located in the depth direction.

Thirdly, still any of the contacts 21 predetermined are still further pushed into the insulator 23 so that the contact portions 212 are located at a third location where the contact portions 212 of the contacts 21 as the VCC and the GND contacts must be located in the depth direction.

Thus, the contact portions 212 of the VCC and the GND, the signal, and the DC contacts are respectively protruded in three lengths longer than one another in this order and the manufacturing has finished.

Figure 2:
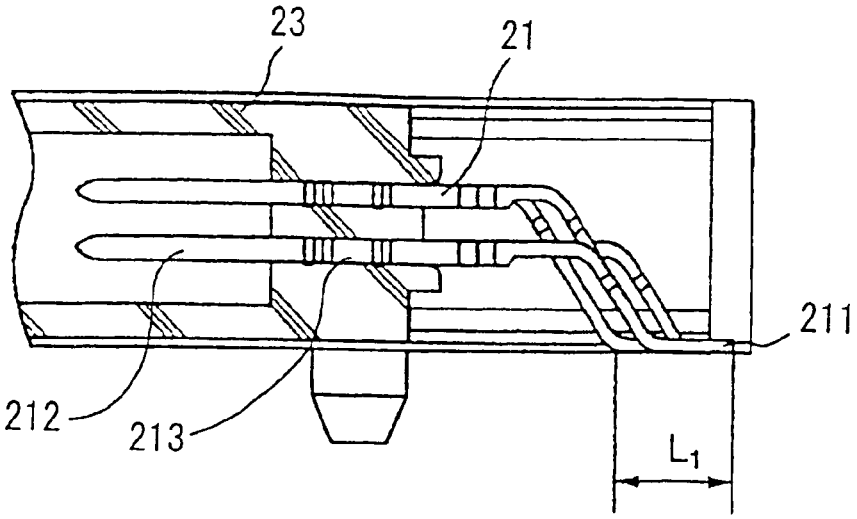
Fig.2 Prior Art
FIG. 2 is a cross-sectional view showing the conventional hot-plug connector.
Figure 3:
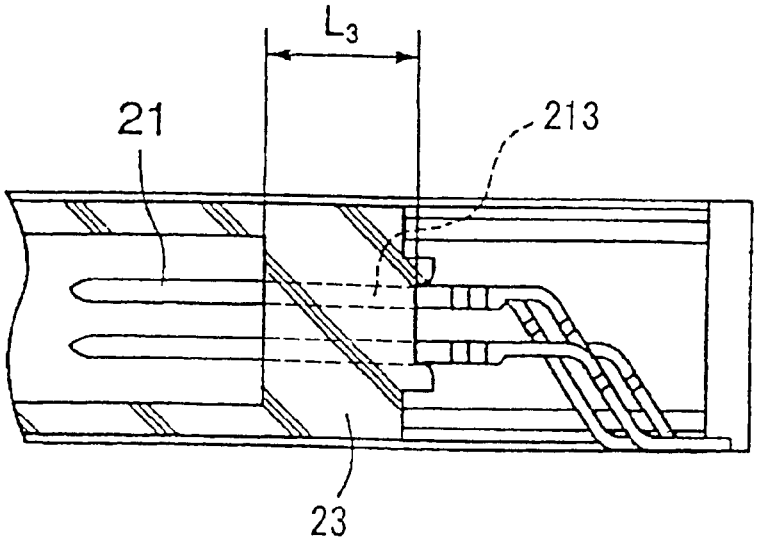
Fig.3 Prior Art
FIG. 3 is the other cross-sectional view showing the conventional hot-plug connector.

As apparent from FIGS. 2 and 3, the contacts 21 are located at three (the first, the second, and the third) locations in the depth direction so as to correspond to the uses thereof, respectively.

Referring to FIG. 2, the peg portions 211 are located over an area $L_1$ in the depth directions. The area $L_1$ is longer than an area for the peg portion 211 for a single use. This fact causes that the electrical circuit board is increased in area for mounting the conventional hot-plug connector. Furthermore, the contact-flatness is deteriorated because it is impossible to limit the contact-flatness to smaller value over long length $L_1$. For example, it is impossible to reach the contact-flatness not larger than 0.1 mm.

Referring to FIG. 3, the squeezed portions 213 are also located over an area $L_3$ in the depth directions. The area $L_3$ is longer than an area for the squeezed portion 213 for a single use. This fact also causes that the electrical circuit board is increased in area for mounting the conventional hot-plug connector.

Now, preferred embodiments of this invention will be described with reference to drawings.

First Embodiment

Figure 4:
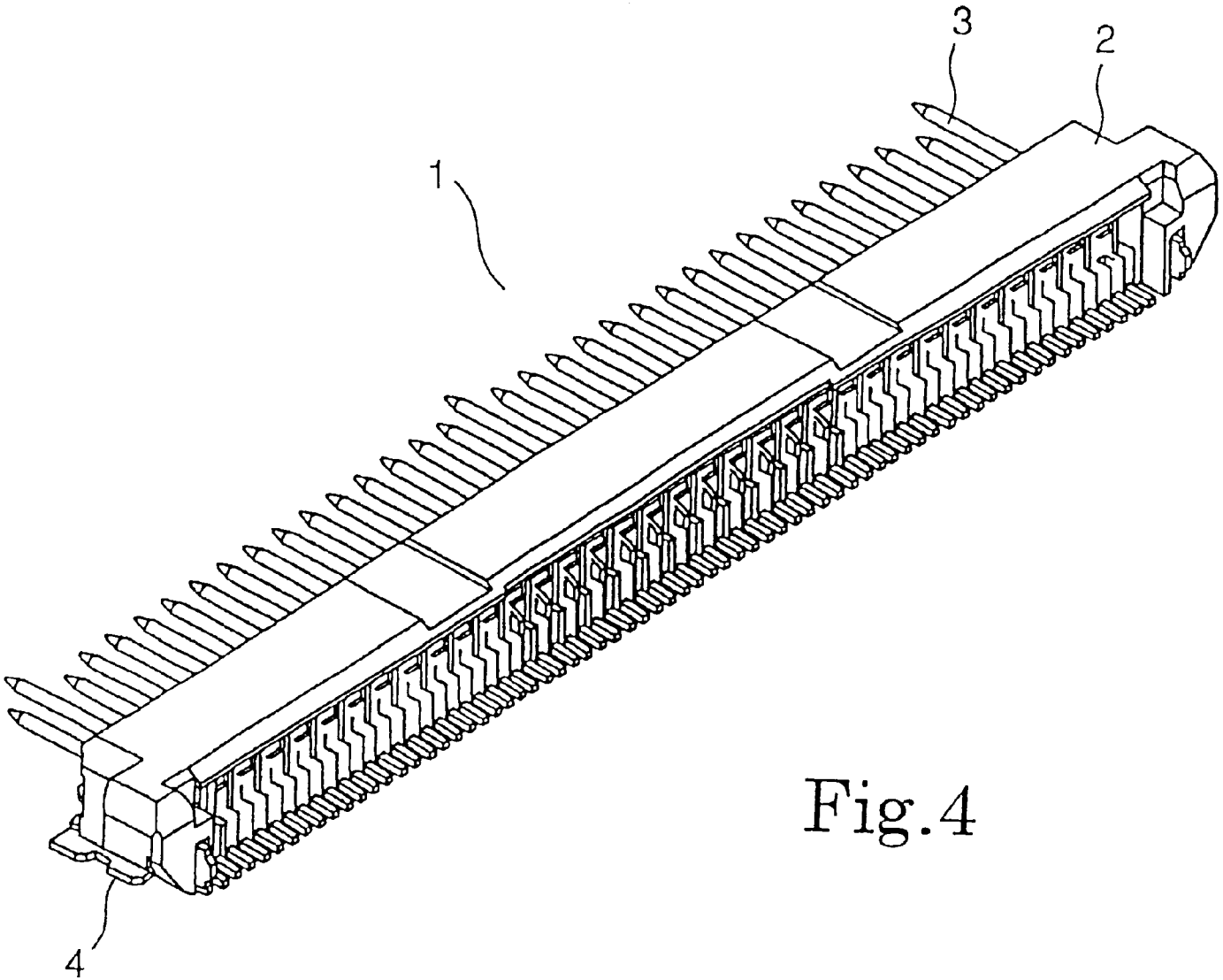
FIG. 4 is a perspective view showing a hot-plug connector according to a first embodiment of this invention.
Figure 5:
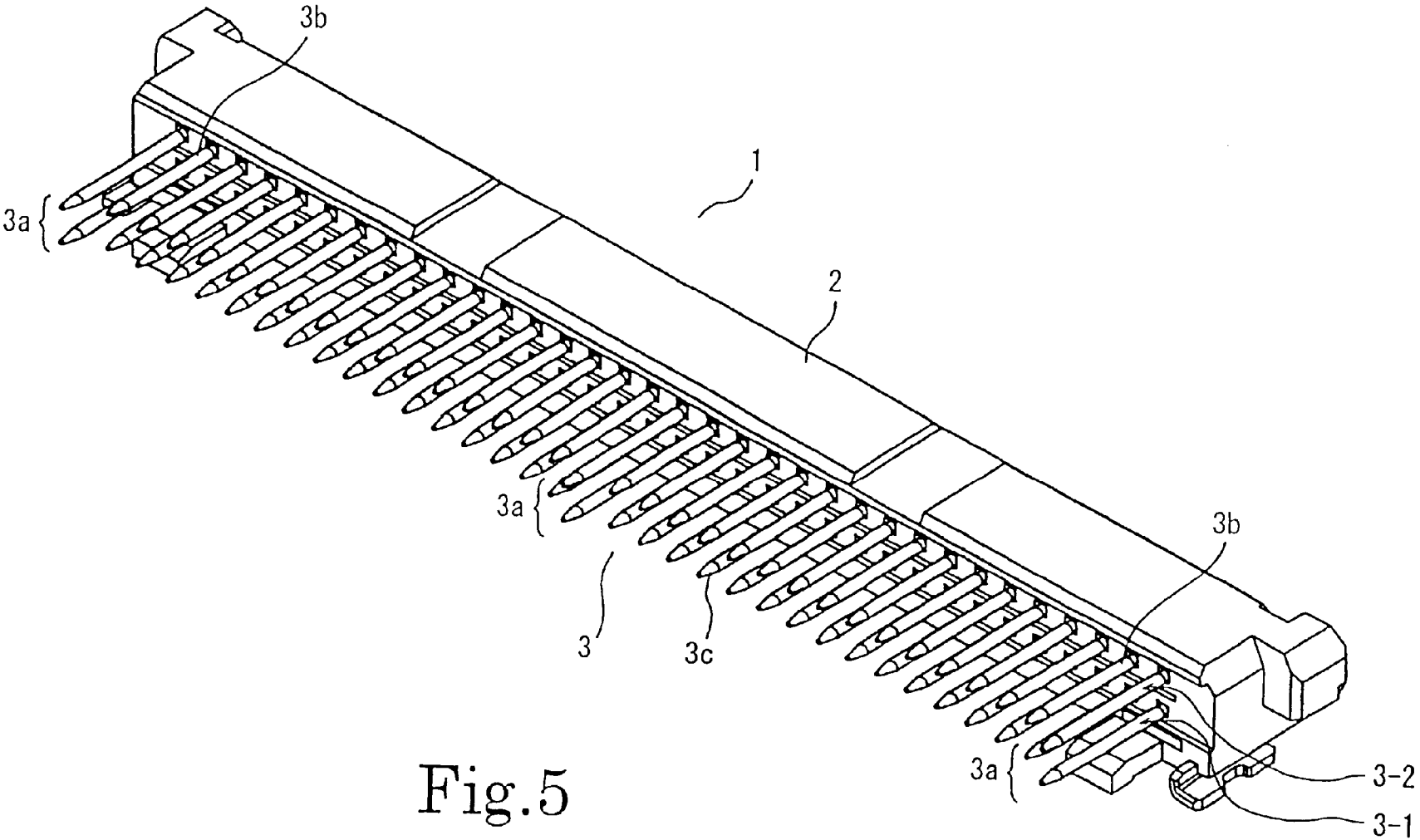
FIG. 5 is the other perspective view showing the hot-plug connector according to the first embodiment of this invention.
Figure 6:
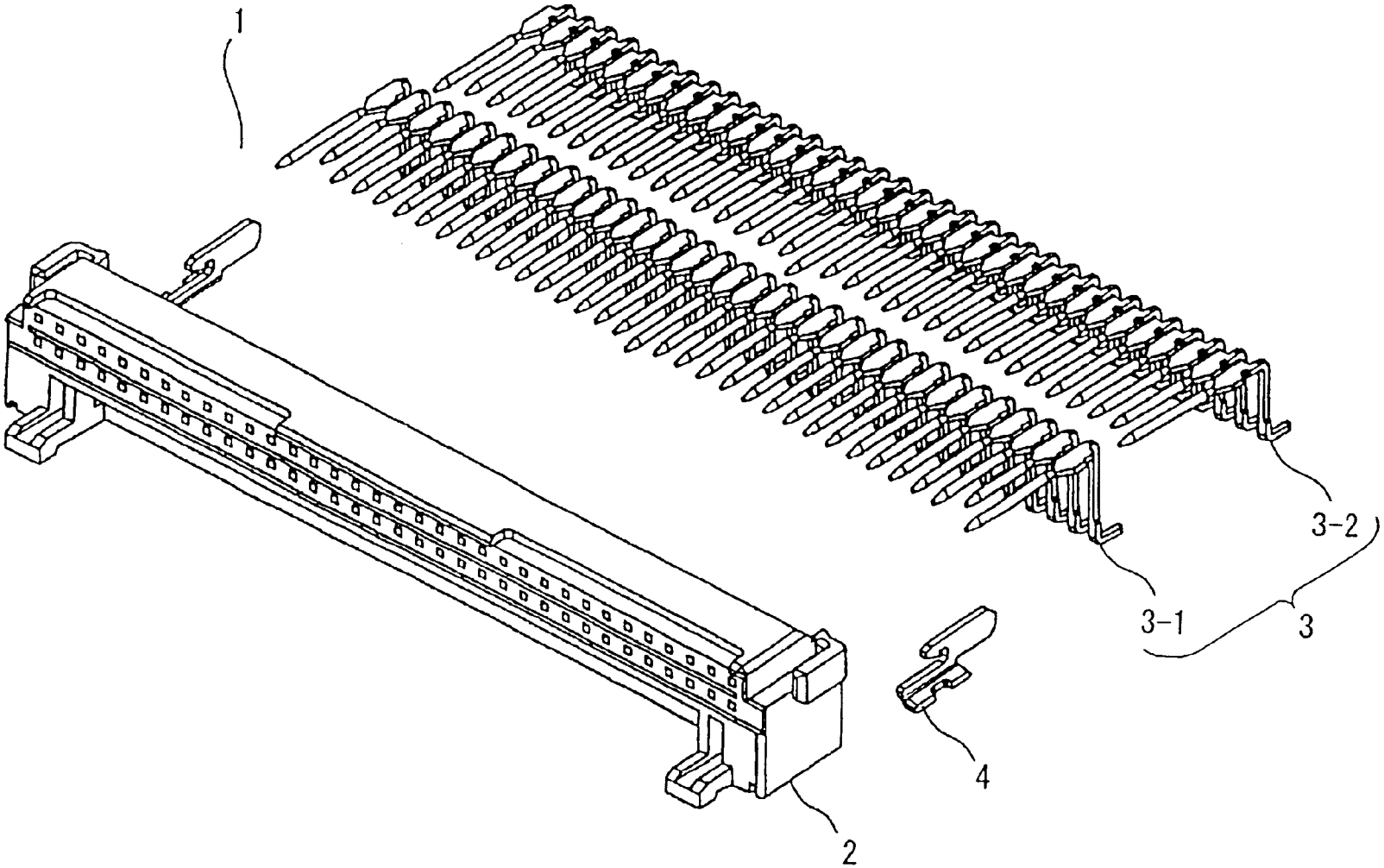
FIG. 6 is a perspective view showing the hot-plug connector disassembled according to the first embodiment of this invention.

Referring to FIGS. 4 to 6, a hot-plug connector 1 according to a first embodiment of this invention can carry out electrical and removable connection between an electrical circuit board (not shown) mounting the hot-plug connector 1 thereon and a PC card as an electrical device (not shown) having a mating connector (not shown) removably connected to the hot-plug connector 1 even while electric power is supplied to the electrical circuit board and/or the PC card.

Referring to FIG. 4, the hot-plug connector 1 comprises a plurality of contacts 3 used for a plurality of the uses, an insulator 2 used for holding the contacts 3 on the electrical circuit board so that the contacts 3 are arranged in a width direction which is parallel to a main surface of the electrical circuit board, and a pair of hold downers 4 attached to both ends of the insulator 2 in the width direction and used for holding the insulator 2 on the electrical circuit board.

As shown in FIG. 6, the contacts 3 is grouped into a first and a second contact groups 3-1 and 3-2. The first and the second contact groups 3-1 and 3-2 are arranged in superposed on each other in a height direction to be perpendicular to the main surface of the electrical circuit board.

Referring to FIG. 5, the contacts 3 include six VCC and GND contacts 3*a* (for power supplying and grounding), two CD contacts 3*b* (for detecting the PC card) of the hot-plug connector 1 connect to the mating contacts, and sixty signal contacts 3*c* (for transmitting data signals and the like). Namely, the total number of the contacts 3 amounts to sixty-eight that is standardized by PCMCIA. The VCC and GND contacts 3*a* are arranged on the both ends and the middle in width direction at the first and the second groups 3-1 and 3-2.

The DC contacts 3*b* are arranged on inward seconds from the both ends at the second group 3-2. The signal contacts 3*c* are arranged as the leftover of subtracting the VCC, the GND, and the signal contacts 3*a*, 3*a*, and 3*c* from sixty-eight contacts 3. The VCC and the GND, the signal, and the DC contacts 3*a*, 3*c*, and 3*b* are protruded in the depth direction so as to be longer than one another in this order. In other words, the VCC and the GND, the signal, and the DC contacts 3*a*, 3*c*, and 3*b* are "longer contacts", "shorter contacts", and "middle or medium contacts" in length, respectively.

Figure 7A:
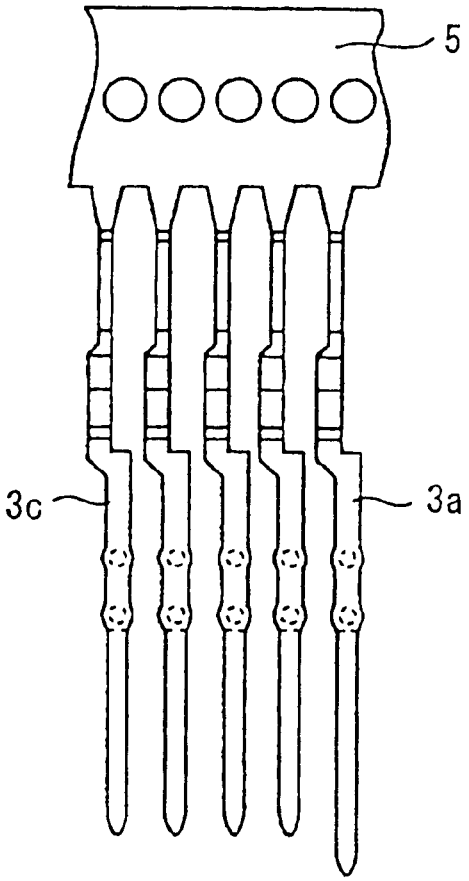
FIGS. 7A and 7B are a plan view and a side view showing contacts which will be used in the hot-plug connector according to the first embodiment of this invention.
Figure 7B:
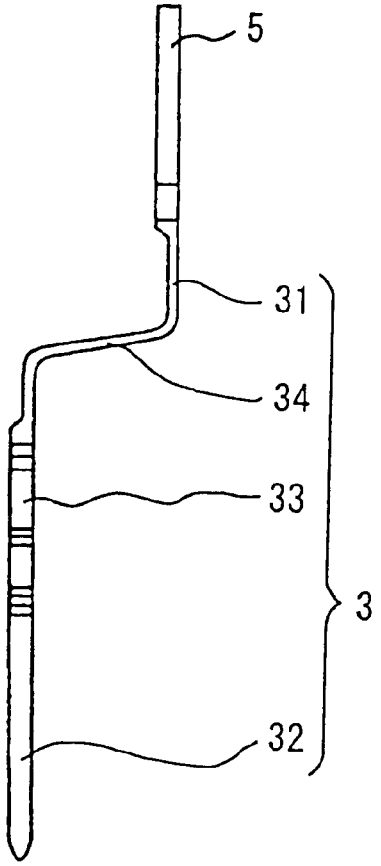

Referring to FIGS. 7A and 7B, each of the con, tacts 3 is provided with a peg portion 31, a contact portion 32, and a squeezed portion 33. The peg portion 31 is located on one end of the contact 3 in the depth direction (left and right directions in FIGS. 8 and 9) parallel to the main surface of the electrical circuit board and along which the mating connector is connected to/removed from the hot-plug connector and used for being mounted by soldering on the main surface of the electrical circuit board. The con tact portion 32 is located on the other end of the contact 3 in the depth direction and used for the removable connection to a mating contact of the mating connector. The squeezed portion 33 is located between the peg and the contact portions 31 and 32 in the depth direction and used for being pushed into and hold by the insulator 2. Each of the contacts 3 is further provided with an extended portion 34, located between the peg and the squeezed portions 31 and 33 in the depth direction.

The hot-plug connector 1 is manufactured as the follows.

The contacts 3 are prepared. Herein, the contacts 3 are connected to one another by a carrier-frame 5 so that the peg portions 31 are arranged in line (in left and right directions in FIGS. 7A and 7B) as shown in FIGS. 7A and 7B.

In the contacts 3, the peg portions 31 are equal in length to one another in the depth direction (upward and downward directions in FIGS. 7A and 7B). Also, the squeezed portions 33 are equal in length to one another in the depth direction. However, the contact portions 32 are different in length in the depth direction from one another so as to correspond to the. uses. Concretely, the contact portions 32 of the VCC and the GND, the signal, and the DC (not shown in FIGS. 7A and 7B) contacts 3*a*, 3*c*, and 3*b* are protruded in the depth direction so as to be longer than one another in this order. In other words, the contacts portions 32 of the VCC and the GND, the signal, and the DC contacts 3*a*, 3*c*, and 3*b* are "longer contact portions", "shorter contact portions", and "middle or medium contact portions" in length, respectively.

Figure 8:
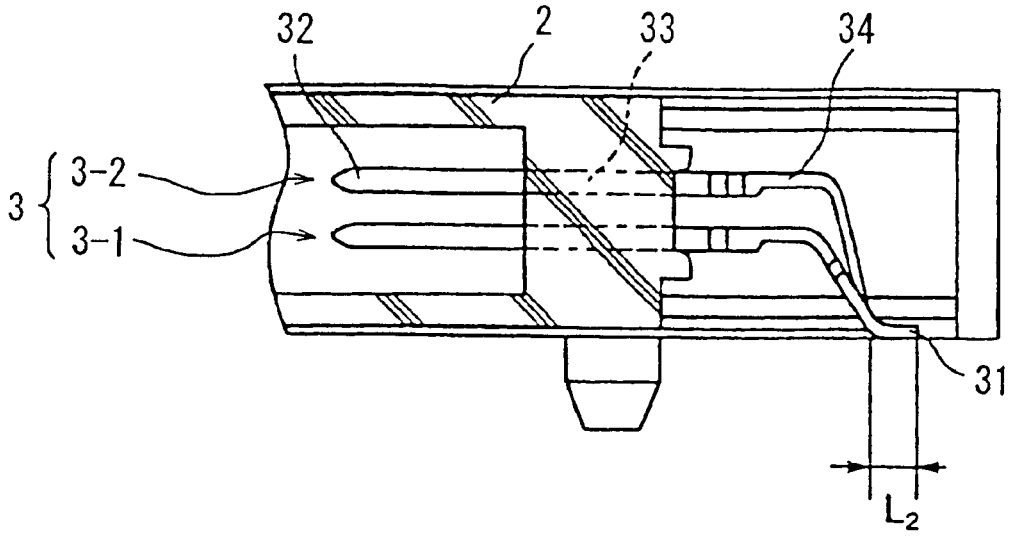
FIG. 8 is a cross-sectional view showing the hot-plug connector according to the first embodiment of this invention.
Figure 9:
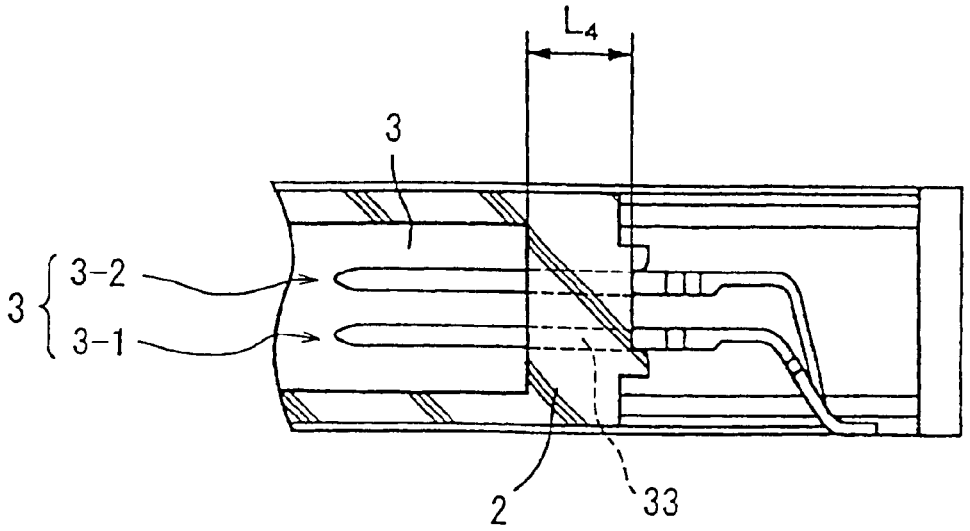
FIG. 9 is the other cross-sectional view showing the hot-plug connector according to the first embodiment of this invention.

Furthermore, the extended portions 34 of the second contact group 3-2 are extended longer than the extended portions 34 of the first contact group 3-1 in the height direction, as apparent from FIGS. 8 and 9 but not from FIGS. 7A and 7B.

Next, the contacts 3 are attached to the insulator 2 by pushing the contacts 3 into (holes formed through) the insulator 2 only at one time.

Namely, all of the contacts 3 shown in FIGS. 7A and 7B are pushed or squeezed into the insulator 2 so that the squeezed portions 33 are located at a location where the squeezed portions 33 of all of the VCC and the GND, the signal, and the DC contacts 3*a*, 3*b*, and 3*c* must be located in the depth direction. Then, the carrier-frame 5 is cut away from the contacts 3.

Consequently, the contact portions 32 are protruded to different locations where the contact portions 32 of the contacts 3 as the DC, the signal, and the VCC and the GND contacts 3*b*, 3*c*, and 3*a* must be respectively protruded in the depth direction. Also, the peg portions 31 are located on the main surface of the electrical circuit board at the same location in the depth direction.

Particularly, the peg portions 31 of the first and the second contact groups 3-1 and 3-2 are located on the main surface of the electrical circuit board at the same level and the same location in the height and the depth direction. The squeezed portions 33 of the first and the second contact groups 3-1 and 3-2 are superposed on each other in the height direction and located at the same location in the height direction. The contact portions 32 of the first and the second contact groups 3-1 and 3-2 are superposed on each other in the height direction and protruded to the different location in the depth direction.

Thus, the contact portions 32 of the VCC and the GND, the signal, and the DC contacts 3*a*, 3*b*, and 3*c* are respectively protruded in three lengths longer than one another in this order and the manufacturing has finished.

As apparent from 8, the peg portions 31 are located over an area $L_2$ in the depth directions. The area $L_2$ is equal in the length for the peg portion 31 for a single use and is less in the length than the length of the area $L_1$ in the conventional hot-plug connector illustrated by FIG. 2. Consequently, the electrical circuit board is not increased in area for mounting the hot-plug connector 1. Furthermore, the contact-flatness is excellent because it is possible to limit the contact-flatness to smaller value over the area $L_2$. For example, it is possible to reach the contact-flatness not larger than 0.1 mm.

Referring to FIG. 9, the squeezed portions 33 are also located over an area $L_4$ in the depth directions. The area $L_4$ is equal in the length for the squeezed portions 33 for a single use and is less in the length than the length of the area $L_3$ in the conventional hot-plug connector illustrated by FIG. 3. Consequently, the electrical circuit board is not increased in area for mounting the hot-plug connector 1.

Second Embodiment

Figure 10:
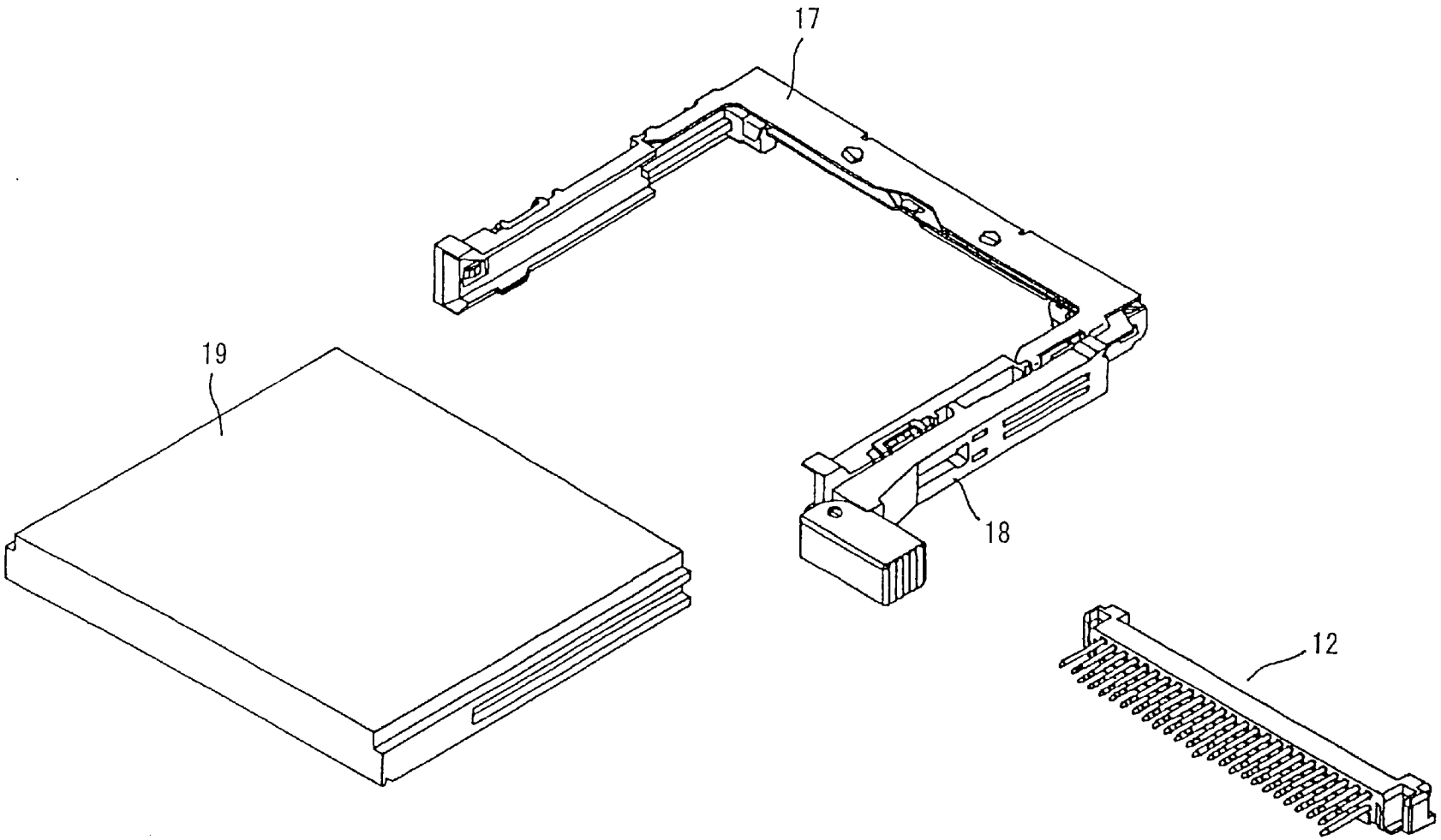
FIG. 10 is a perspective view for illustrating the use of a hot-plug connector according to a second embodiment of this invention.

Referring to FIG. 10, a hot-plug connector 12 according to a second embodiment of this invention can carry out electrical and removable connection between an electrical circuit board (not shown) mounting the hot-plug connector 12 thereon and a CF (Compact-type Flash-memory) card 19 as an electrical device having a mating connector (not shown) removably connected to the hot-plug connector 12 even while electric power is supplied to the electrical circuit board and/or the CF card 19. The hot-plug connector 12 is used with a holding frame 17, which arranged over or adjacent to the electrical circuit board, for removably holding the CF card. The holding frame 17 is provided with an eject mechanism 18 for eject the CF card 19 contained therein.

Figure 11B:
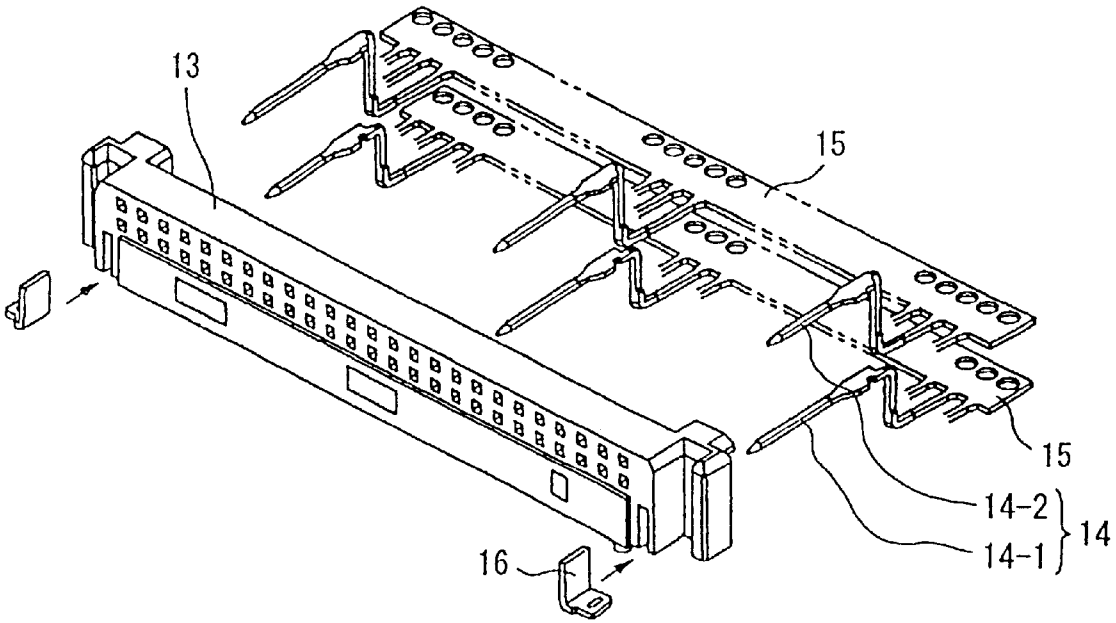
FIGS. 11A and 11B are perspective views showing the hot-plug connector and that disassembled.
Figure 11A:
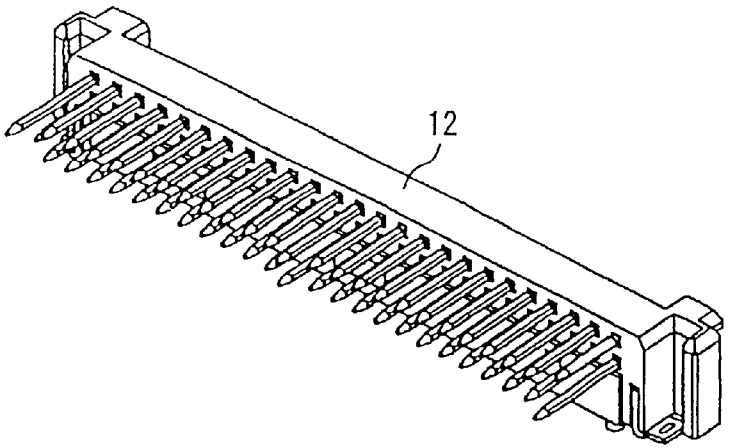

Referring to FIGS. 11A and 11B, the hot-plug connector 12 comprises a plurality of contacts 14 used for a plurality of the uses, an insulator 13 used for holding the contacts 14 on the electrical circuit board so that the contacts 14 are arranged in a width direction which is parallel to a main surface of the electrical circuit board, and a pair of hold downers 16 attached to both ends of the insulator 13 in the width direction and used for holding the insulator 13 on the electrical circuit board.

As like as the first embodiment, the contacts 14 is grouped into a first and a second contact groups 14-1 and 14-2. The first and the second contact groups 14-1 and 14-2 are arranged in superposed on each other in a height direction to be perpendicular to the main surface of the electrical circuit board. The contacts 14 include VCC and GND contacts, CD contacts, and signal contacts. The total number of the contacts 14 amounts to fifty that is standardized by PCMCIA. The VCC and the GND, the signal, and the DC contacts are protruded in the depth direction so as to be longer than one another in this order.

Each of the contacts 14 is provided with peg, contact, squeezed, and extended portions. The contact portions are different in length in the depth direction from one another so as to correspond to the uses. Concretely, the contact portions of the VCC and the GND, the signal, and the DC contacts are protruded in the depth direction so as to be longer than one another in this order.

The hot-plug connector 12 is manufactured as like as the first embodiment.

The contacts 14 are prepared. Herein, the contacts 14 are connected to one another by a carrier-frame 15 so that the peg portions are arranged in line.

Next, the contacts are attached to the insulator 13 by pushing the contacts 14 into (holes formed through) the insulator 13 only at one time. Namely, all of the contacts 14 shown are pushed or squeezed into the insulator 13 so that the squeezed portions are located at a location where the squeezed portions of all of the VCC and the GND, the signal, and the DC contacts must be located in the depth direction. Then, the carrier-frame 15 is cut away from the contacts 14.

Consequently, the contact portions are protruded to different locations where the contact portions of the DC, the signal, and the VCC and the GND contacts must be respectively protruded in the depth direction. Also, the peg portions are located on the main surface of the electrical circuit board at the same location in the depth direction. Particularly, the peg portions of the first and the second contact groups 14-1 and 14-2 are located on the main surface of the electrical circuit board at the same level and the same location in the height and the depth direction. The squeezed portions of the first and the second contact groups 14-1 and 14-2 are superposed on each other in the height direction and located at the same location in the height direction. The contact portions of the first and the second contact groups 14-1 and 14-2 are superposed on each other in the height direction and protruded to the different location in the depth direction. Thus, the contact portions of the VCC and the GND, the signal, and the DC contacts are respectively protruded in three lengths longer than one another in this order and the manufacturing has finished.

The peg portions are located over an area equal in the length for the peg portion for a single use and less in the length!than the length of the area $L_1$ in the conventional hot-plug connector illustrated by FIG. 2. Consequently, the electrical circuit board is not increased in area for mounting the hot-plug connector 12. Furthermore, the contact-flatness is excellent because it is possible to limit the contact-flatness to smaller value over the area $L_2$. For example, it is possible to reach the contact-flatness not larger than 0.1 mm. Furthermore, the squeezed portions are also located over an area equal in the length for the squeezed portions for a single use and less in the length than the length of the area $L_3$ in the conventional hot-plug connector illustrated by FIG. 3. Consequently, the electrical circuit board is not increased in area for mounting the hot-plug connector 12.

While this invention has thus far been described in conjunction with embodiments thereof, it will readily be possible for those skilled in the art to put this invention into practice in various other manners. For example, this invention may be applied to another hot-plug connector used for connecting to another electrical device different from the PC card (including the CF card).

What is claimed is:

1. A hot-plug connector capable of carrying out an electrical and removable connection between an electrical circuit board mounting said hot-plug connector thereon and an electrical device having a mating connector removably connected to said hot-plug connector even while electric power is supplied to the electrical circuit board and/or the electrical device, said hot-plug connector comprising a plurality of contacts used for a plurality of different uses and an insulator used for holding said contacts on the electrical circuit board so that said contacts are arranged in a width direction which is parallel to a main surface of the electrical circuit board, each of said contacts having a peg portion, located on one end of said contact in a depth direction which is parallel to the main surface of the electrical circuit board and along which the mating connector is connected to/removed from said hot-plug connector, for being mounted on the main surface of the electrical circuit board, an extended portion extending from said peg portion; a contact portion, located on the other end of said contact in said depth direction, for making a removable connection to a mating contact of the mating connector, and a squeezed portion, located between said extended and said contact portions in said depth direction, for being pushed into and held by said insulator; wherein:

said connector being constructed by use of a surface technology;

said peg portions have lengths which are equal to one another in said depth direction;

said extended portions being parallel to each other in an inclined direction;

said squeezed portions have a length which is equal to one another in said depth direction;

said contact portions have a length which is different from one another in said depth direction in order to correspond to the uses;

said peg portions, said squeezed portions and said contact portions being arranged to extend parallel to the main surface;

said peg portions of all of said contacts being located on the main surface of the electrical circuit board at the same location in said depth direction and at the some level, a height direction, said height direction being perpendicular to the main surface of the electrical circuit board;

said squeezed portions being located at the same location in said depth direction; and said contact portions protruding to the different location from one another in said depth direction.

2. A hot-plug connector as claimed in claim 1, wherein;

said hot-plug connector comprises first and second contact groups having said contacts, respectively;

said first and said second contact groups being arranged and superposed on each other in said height direction;

said contacts being further provided with an extended portion, located between said peg and said squeezed portions in said depth direction;

said extended portions of said second contact group extending longer than said extended portions of said first contact group in said height direction;

said peg portions of every one of said contacts of said first and said second contact groups being located on a main surface of the electrical circuit board at the same level in said height direction and the same location in said depth direction;

said squeezed portions of said first and said second contact groups being superposed on each other in said height direction and located at the same location in said height direction; and said contact portions of said first and said second contact groups being superposed on each other in said height direction and protruding to the different location in said depth direction.

3. A method of manufacturing a hot-plug connector by use of a surface mounted technology, said hot-plug connector being capable of carrying out an electrical and removable connection between an electrical circuit board mounting said hot-plug connector thereon and an electrical device having a mating connector removably connected to said hot-plug connector even while electric power is supplied to the electrical circuit board and/or the electrical device, said hot-plug connector comprising a plurality of contacts used for a plurality of different uses and an insulator used for holding said contacts on the electrical circuit board so that said contacts are arranged in a width direction which is parallel to a main surface of the electrical circuit board, each of said contacts being provided with a peg portion, located on one end of said contact in a depth direction which is parallel to the main surface of the electrical circuit board and along which the mating connector is connected to/removed from said hot-plug connector, for being mounted on the main surface of the electrical circuit board, a contact portion located on the other end of said contact in said depth direction, for the removable connection to a mating contact of the mating connector, and a squeezed portion located between said peg and said contact portions in said depth direction, for being pushed into and held by said insulator; wherein said method comprises the steps of:

preparing said contacts so that lengths of said peg portions are equal to one another in said depth direction, that lengths of said squeezed portions are equal to one another in said depth direction, that lengths of said contact portions are different from one another in said depth direction so as to correspond to the uses, and that said contacts are connected to one another by a carrier-frame so that said peg portions are arranged in line;

attaching said contacts to said insulator by pushing said contacts into said insulator so that said peg portions, said squeezed portions, and said contact portions are arranged and to be extended in parallel to the main surface, said peg portions of all of said contacts are located at the same level in a height direction and the same location in said depth direction, that said squeezed portions being located at the same location in said depth direction, and that said contact portions protruding to the different location from one another in said depth direction, said height direction being perpendicular to the main surface of the electrical circuit board; and cutting said carrier-frame away from said contacts.

4. A method of manufacturing a hot-plug connector as claimed in claim 3, wherein:

the preparing step preparing said contacts so that said contacts serve as first and second contact groups having said contacts, respectively, that said carrier-frame serve as first and second carrier frames connected to said peg portions of said first and said second contact groups, respectively, that said contacts have an extended portion, located between said peg and said squeezed portions in said depth direction, and that said extended portions of said second contact group are extended longer than said extended portions of said first contact group in said height direction;

the attaching step attaching said contacts to said insulator so that said first and said second contact groups are superposed on each other in said height direction so that said peg portions of every one of said contacts of said first and said second contact groups are located at the same level in said height direction and the same location in said depth direction, that said squeezed portions of said first and said second contact groups are superposed on each other in said height direction and located at the same location in said depth direction, and that said contact portions of said first and said second contact groups are superposed on each other in said height direction and protrude to the different location in said depth direction.

* * * * *